US006078144A

United States Patent [19]

Twardzik

[11] Patent Number: 6,078,144

[45] Date of Patent: Jun. 20, 2000

[54] ELECTRONIC BALLAST WITH INRUSH CURRENT LIMITING

[75] Inventor: Rene Twardzik, Traunreut, Germany

[73] Assignee: Patent-Treuhand-Gesellschaft fuer elektrische Gluehlampen mbH, Munich, Germany

[21] Appl. No.: 09/346,913

[22] Filed: Jul. 2, 1999

[30] Foreign Application Priority Data

Jul. 7, 1998 [DE] Germany ..... 198 30 368

[51] Int. Cl.[7] ..... H05B 37/02

[52] U.S. Cl. ..... 315/209 R; 315/219; 315/224; 315/DIG. 7

[58] Field of Search ..... 315/224, 209 R, 315/219, DIG. 7

[56] References Cited

U.S. PATENT DOCUMENTS 5,343,122 8/1994 Sugimori et al. ..... 315/209 R

FOREIGN PATENT DOCUMENTS 0423885 4/1991 European Pat. Off. .

OTHER PUBLICATIONS

"Betriebsgeräte und Schaltungen für elektrische Lampen" [Operating equipment and circuits for electric lamps], 6th edition, 1992, Verlag Siemens AG, Chapter 2.4.3 and 2.4.4, pp. 123 to 129, Von Carl Heinz Sturm und Erwin Klein.

"Illuminating Engineering", May 1960, pp. 247 to 253, a conference report regarding the National Technical Conference of the Illuminating Engineering Society, Sep. 7–11, 1959, San Francisco, John H. Campbell, "New Parameters for High Frequency Lighting Systems".

*Primary Examiner*—David Vu
*Attorney, Agent, or Firm*—Carlo S. Bessone

[57] ABSTRACT

The electronic ballast has a rectifier arrangement (1)—which is fed by AC power supply voltage (U)—with active step-up converter (SW2), a storage capacitor (C2), a network for limiting an inrush current and two outputs, at which a stabilized DC voltage (U+) referred to housing ground as reference potential (Uref) is output. An inverter (2) is connected to the rectifier arrangement, a load circuit (3) with at least one fluorescent lamp (La1 and/or La2) being assigned to said inverter on the output side. The inverter has a converter network (T1/1, T1/2, C1, SW3, SW4), preferably designed as a push-pull circuit, with two bridge paths, which, in the steady-state operating condition, are alternatively switched through to the reference potential. In this case, the switching network for limiting the inrush current comprises a limiting resistor (R1), which, in series with the storage capacitor (C2), is connected to reference potential. The junction point between the storage capacitor and the limiting resistor is coupled to the two bridge paths of the converter network in such a way that it is connected, in the steady-state condition of the inverter, via the latter to housing ground and the limiting resistor, which is thus effective only in the switch-on phase, is bridged.

19 Claims, 3 Drawing Sheets

ELECTRONIC BALLAST WITH INRUSH CURRENT LIMITING

Figure 1:
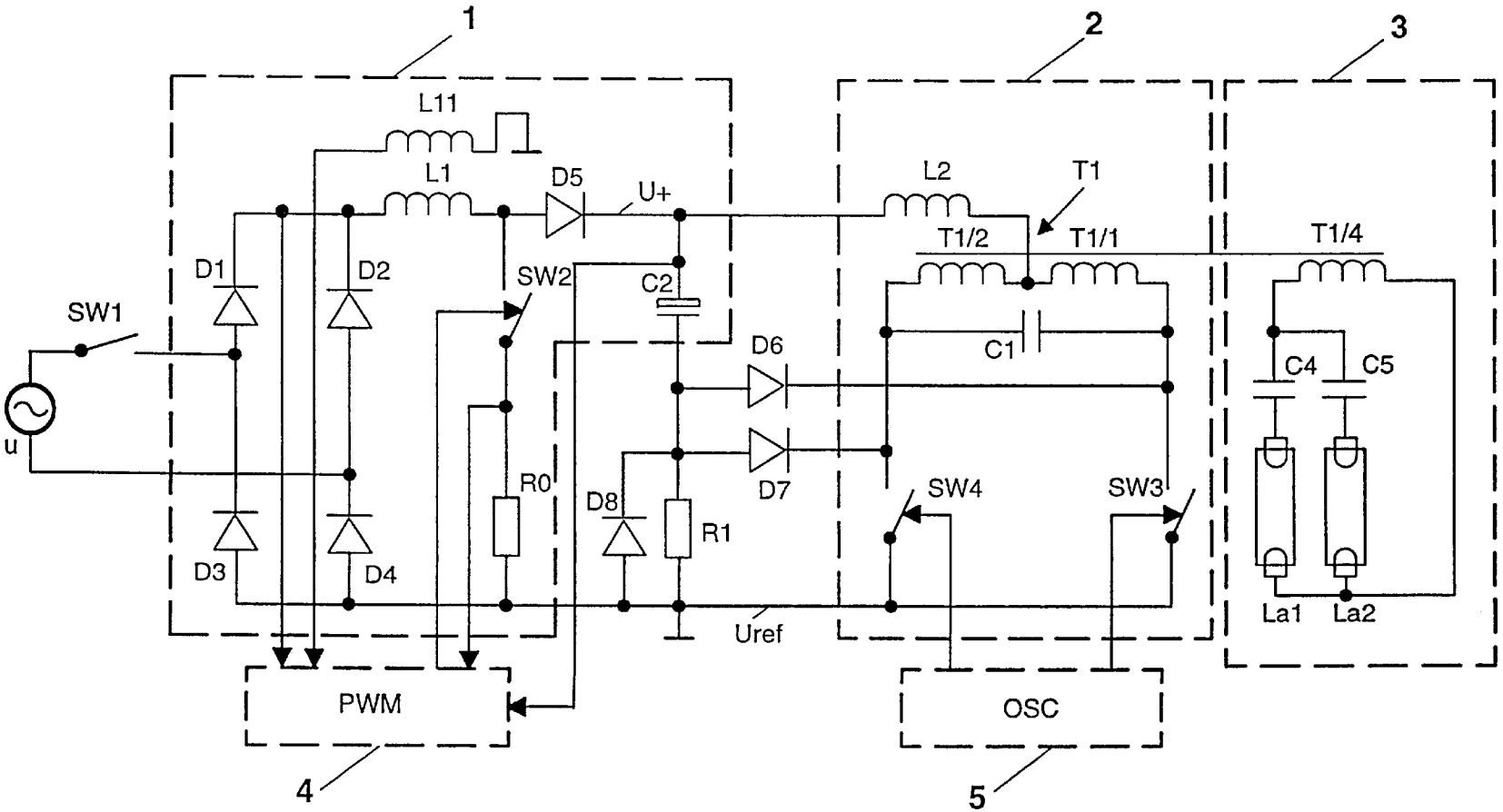

The invention relates to an electronic ballast for at least one fluorescent lamp in accordance with the preamble of patent claim 1.

I. PRIOR ART

As an operating circuit for fluorescent lamps which is usually fed from the public power supply system, an electronic ballast generally has a harmonic filter which is connected to the power supply voltage and to which a rectifier circuit with step-up converter is connected. By means of the latter, the rectified voltage in this particular group of power supply units is usually raised approximately to the peak value of the feeding AC voltage and held there. The step-up converter charges a storage capacitor in a defined manner up to the charge level predetermined thereby. This storage capacitor thus forms a voltage-stabilized output stage of the rectifier circuit. Supplying the load circuit containing the fluorescent lamp(s) with a high-frequency AC voltage, which, if appropriate, is also variable in terms of its frequency, is another special feature of electronic ballasts. For this purpose, an inverter is connected to the rectifier circuit and, finally, feeds the load circuit with said AC voltage in the form of a high-frequency pulse train.

This construction of electronic ballasts as outlined schematically above, with regard to which a multiplicity of circuit variants are known, is described e.g. in "Betriebsgerä te und Schaltungen für elektrische Lampen" [Operating equipment and circuits for electric lamps], 6th edition, 1992, Verlag Siemens AG, in Chapter 2.4.3 and 2.4.4, pages 123 to 129. The inverter described and illustrated in this document is constructed in the form of a half-bridge circuit with a pair of power transistors. This is a circuit variant which is used many times in modern electronic ballasts. One of the reasons for this is that semiconductor components can be integrated relatively well even when, at the same time, special requirements are imposed on their voltage endurance. However, other embodiments are also known for such an inverter.

Thus, e.g. as early as in "Illuminating Engineering", May 1960, pages 247 to 253, a conference report regarding the National Technical Conference of the Illuminating Engineering Society, Sep. 7–11, 1959, San Francisco, a solution for a high-frequency lamp operating circuit is described in an early stage. The inverter disclosed therein is realized in the form of a push-pull chopper. The latter is formed by an oscillatory transformer with two symmetrical windings and switches connected to the latter.

In the document mentioned at the beginning (see FIG. 2.105, page 126), it is furthermore explained that harmonic limiting can be achieved in electronic ballasts inter alia by means of an inductive filter comprising an iron-cored inductor and a capacitor. Effective inrush current limiting is one of the advantages of this circuit variant.

A further solution is afforded by an active step-up converter (see FIGS. 2.107, 2.109 or else 2.111) designed as a switch driven by means of a control loop. In addition to the harmonic limiting, the stabilization of the rectified output voltage of the rectifier arrangement and a low power loss form further advantages of the active step-up converter. Furthermore, this also makes it possible to realize, in addition, smaller designs for electronic ballasts, also because it is not necessary to use voluminous inductors in this case. Therefore, the active step-up converter has gained acceptance in many cases. A significant disadvantage of these electronic ballasts with active step-up converter, however, is their high inrush current during start-up. In the first instance, this means that the circuit has to be realized using correspondingly powerful components, which are thus expensive as well. However, the high inrush current of electronic ballasts with active step-up converter primarily also has to be taken into consideration in the context of the installation and the designing of the power supply connections and their protection. There has been no lack of attempts, therefore, to counter this disadvantage by means of corresponding measures for limiting the inrush current in electronic ballasts.

Thus, EP-A1-0 423 885, for example, discloses such a power supply device with a limiting circuit for the inrush current. In this case, the switching path of a first semiconductor switch, a field-effect transistor, and also, in parallel with said switching path, a non-reactive resistor are arranged in the return path at the low potential of the rectifier arrangement. A parallel circuit having a first capacitor, a further resistor and also the switching path of a second semiconductor switch is connected in parallel with the control path of said first semiconductor switch. The control electrode of said second semiconductor switch is connected to the tap of a first volt age divider, with which a second capacitor is connected in parallel. The switching path of a third semiconductor switch is, in turn, connected in parallel with the control path of said second semiconductor switch. Furthermore, a threshold value circuit with further semiconductor components is provided. This is connected to the control input of the third semiconductor switch and turns the latter off when the supply voltage falls below a predetermined threshold value.

The known circuit inarguably achieves the object of having a low power loss and of being activated again without delay even in the event of frequently and rapidly occurring interruptions of the supply voltage. However, this is undoubtedly paid for with a considerable outlay on circuity, which runs counter to the stipulations of manufacturers of electronic ballasts with regard to attaining minimization of the circuitry using cost-effective components, in order to be able to counter-balance price reductions on the market for their products by more favorable manufacturing costs.

II. SUMMARY OF THE INVENTION

The invention is based on the object, therefore, of providing an electronic ballast of the type mentioned in the introduction in which an active step-up converter is used, in order to be able to utilize the advantages thereof, but in which, at the same time, effective inrush current limiting is attained by the simplest possible means.

In the case of an electronic ballast of the type mentioned in the introduction, this object is achieved by means of the features specified in the characterizing part of patent claim 1.

In the case of this solution, the current limiting is achieved by means of a simple limiting resistor which is connected in series with the storage capacitor and, furthermore, is connected to the return path to the rectifier arrangement, said return path being at low potential, the reference potential. The advantage of such a simple circuit for limiting the inrush current cannot, however, be utilized straightforwardly in interaction with an inverter designed in a contemporarily customary manner, said inverter being constructed from a half-bridge arrangement. This problem is surmounted by designing the inverter as a converter network via which a current path to the storage capacitor is closed as early as in the switch-on phase.

Developments of the invention are defined in subclaims and can be gathered in detail, together with their advantages, from the following description of exemplary embodiments of the invention.

III. DESCRIPTION OF THE PREFERRED EXEMPLARY EMBODIMENTS

Figure 2:
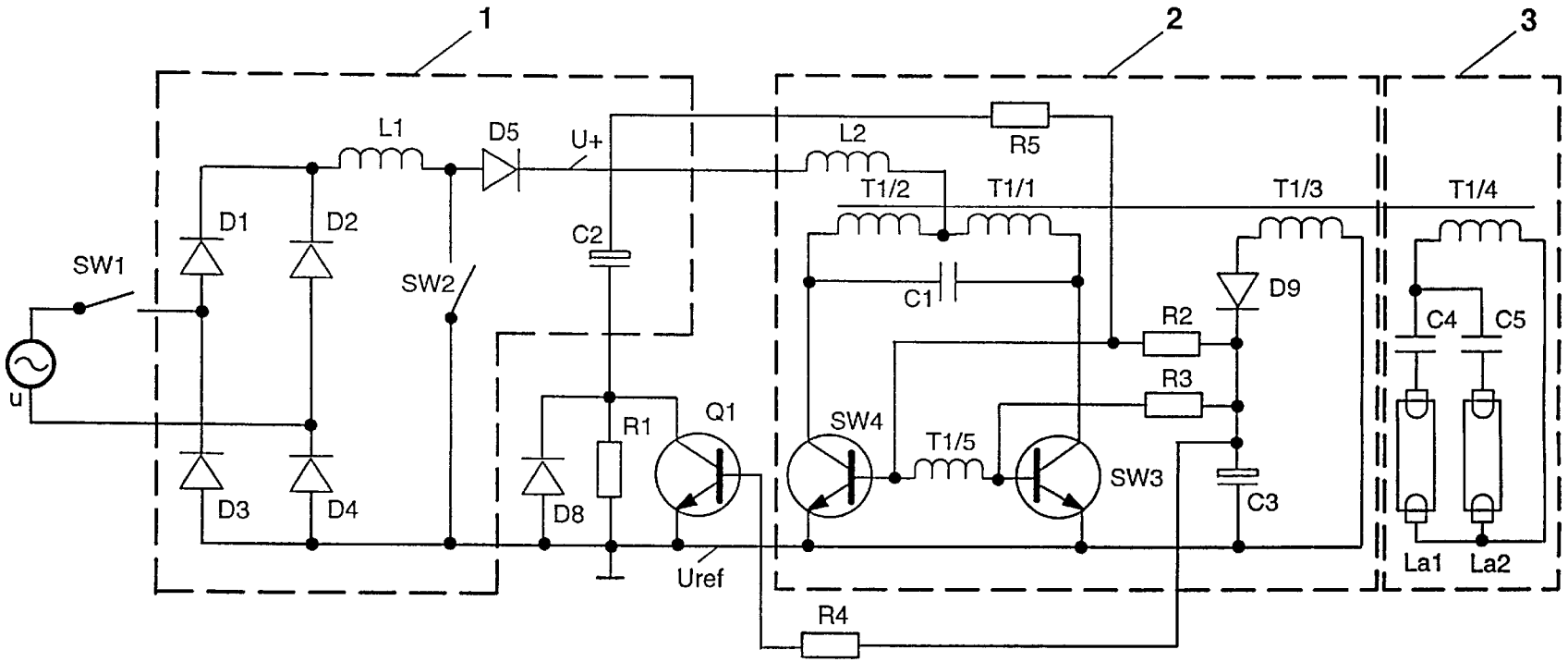
Figure 3:
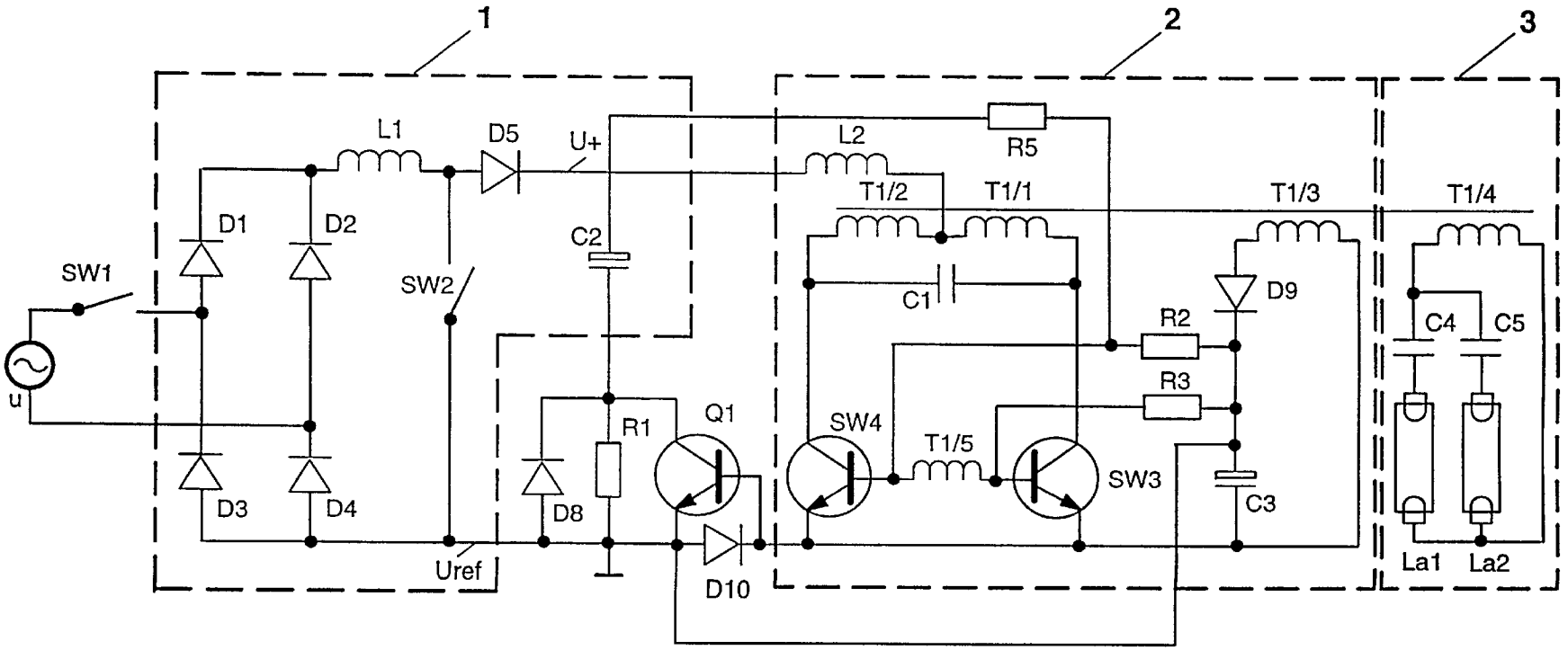

Preferred exemplary embodiments of the invention are described in detail below with reference to the drawing, in which:

FIG. 1 shows a block circuit diagram of an electronic ballast having a rectifier arrangement which is connected to power supply voltage and feeds a stabilized DC voltage to a connected inverter which, for its part, supplies a lamp load circuit with a high-frequency pulse train, the rectifier arrangement being assigned a circuit for inrush current limiting in the form of a resistor arranged in its output stage, FIGS. 2, 3 in each case show a further embodiment of the electronic ballast according to FIG. 1, the circuit for inrush current limiting in each case having a switching transistor whose switching path is connected in parallel with the non-reactive resistor.

FIG. 1 illustrates a block circuit diagram of an electronic ballast for fluorescent lamps, in which a rectifier arrangement 1 is connected, on the input side, to AC power supply voltage u via a conventional power supply switch SW1. This voltage is rectified by means of a rectifier bridge comprising diodes D1 to D4. A charging inductor L1 and also a forward-biased charging diode D5 are serially connected to an output of said rectifier bridge which is at high potential. The output of the rectifier bridge D1 to D4 which is at low potential is connected to housing ground. A defined reference potential Uref for the entire electronic ballast is thus established. On the cathode side, the charging diode D5 is connected to a storage capacitor C2, whose second terminal is connected to reference potential Uref, as will be explained in detail below.

Furthermore, a series circuit comprising the switching path of a second switch, preferably an electronic switch SW2, and a non-reactive resistor R0 is arranged between the junction point between charging inductor L1 and charging diode D5, on the one hand, and the reference potential Uref, on the other hand. This second switch SW2 forms the switching element of a step-up converter of the rectifier arrangement 1. The function of this second switch SW2 is controlled by means of a control unit 4. The inputs thereof are respectively connected to the output of the rectifier bridge D1 to D4 which is at high potential, to an auxiliary winding L11 assigned to the charging inductor L1, to the junction point between the second switch SW2 and the resistor R0 connected in series with the latter, and to the terminal of the storage capacitor C2 which is at high potential. On the output side, this control unit 4 is connected to the control input of the second switch SW2. The rectifier arrangement 1 described above constitutes an inherently known basic circuit of an AC/DC voltage converter with active step-up converter for an electronic ballast. All that is needed, therefore, is a summarizing description of function, as given below. When the power supply switch SW1 is closed, a pulsating DC voltage is output at the outputs of the rectifier bridge D1 to D4. This voltage is to be converted into a stabilized DC voltage U+ by means of the storage capacitor C2 forming the output stage of the rectifier arrangement 1. In this case, the voltage difference between the instantaneous value of the power supply voltage u or the pulsating DC voltage derived therefrom, on the one hand, and the voltage across the storage capacitor C2, on the other hand, is bridged by means of the second switch SW2. If the latter is closed, the current in the charging inductor L1 rises and is detected by means of the auxiliary winding L1. When an envisaged final value is reached, the second switch SW2 opens and the current discharges into the storage capacitor C2. A precondition for this is that the voltage across the storage capacitor C2 is always larger than the power supply voltage u. As soon as this charging current becomes zero, the second switch SW2 is switched on again by means of the control unit 4 assigned to it, until an envisaged desired value is reached. The instantaneous value of the pulsating DC voltage serves as the desired value in this case. Consequently, a defined charged state of the storage capacitor C2 is achieved by means of this circuit. The stabilized DC voltage U+ corresponding to its charged state in this case corresponds to the peak value of the pulsating DC voltage.

An inverter 2, which is in this case designed as a transformer-controlled push-pull chopper, is connected to the rectifier arrangement 1. It converts the stabilized DC voltage U+ fed in by the rectifier arrangement 1 into a high-frequency pulse train. In the case of the embodiment illustrated in FIG. 1, the output of the rectifier arrangement 1 which is at high potential is connected, in the inverter 2, via a second inductor L2 to the common junction point between two primary windings T/1 and T1/2 of an oscillatory transformer Ti. Second terminals of these primary windings T1/1 and T1/2 are connected, in the first instance, to one another via a resonance capacitor C1 which is connected in parallel with both of them. Furthermore, these terminals are respectively connected to the reference potential Uref via the switching path of one of two further switches SW3 and SW4. A drive network 5 for these two further switches SW3 and SW4 is specified schematically in FIG. 1; circuit details with respect to said drive network are illustrated in the further FIGS. 2 and 3, as will be described below.

The basic circuit, illustrated in FIG. 1, for the inverter 2 with the symmetrically constructed oscillatory transformer T1 is also inherently known; therefore, the function of the inverter 2 shall be summarized as follows. The drive unit 5 is designed such that it alternatively switches on one of the two further switches SW3 and SW4. If it is assumed that the switch SW3 is in the on state with the switching path closed, then current flows via the further inductor L2 and one primary winding T1/1—assigned to this instantaneously turned-on switch SW3—of the oscillatory transformer T1 back into the rectifier arrangement 1. As a result, the resonance capacitor C1 is charged at the same time, the voltage at the instantaneously turned-off switch SW4 rising. With the next control pulse of the drive unit 5, this switch SW4 is switched on, the resonance capacitor C1 initially being discharged and, on account of the current flow through the second primary winding T1/2, being charged in the opposite direction. As the figurative expressiveness is very apt, the expression "push-pull" circuit has also been adopted in German usage for a circuit of this type.

As is furthermore shown by FIG. 1, a lamp load circuit 3 is inductively coupled to the inverter 2 via a secondary winding T1/4 of the oscillatory transformer T1. A bipolar pulse train is coupled into the lamp load circuit 3 via said inverter, the frequency of which pulse train is predetermined by the switching periods of the two switches SW3 and SW4 of the inverter 2. Merely by way of example, two fluorescent lamps La1, La2 are provided in the lamp load circuit. In this case, one of the filaments of the fluorescent lamps La1 and La2 in each case is connected via a respective limiting capacitor C4 and CS to one of the terminals of the secondary winding T1/4. The other filaments of the fluorescent lamps are jointly connected directly to the second terminal of said secondary winding T1/4, Finally, a network assigned to the storage capacitor C2 is furthermore illustrated in FIG. 1. This network contains a further non-reactive resistor R1, which is henceforth referred to as a limiting resistor. This limiting resistor, in series with the storage capacitor C2, is connected to the return path into the rectifier arrangement 1, said return path being at reference potential Uref. The junction point between the storage capacitor C2 and the limiting resistor R1 is connected via a respective coupling diode D6 and D7 to that terminal of the further switches SW3 and SW4, respectively, which is connected to the corresponding primary winding T1/1 and T1/2, respectively, of the oscillatory transformer T1. A further diode D8 is connected in parallel with the limiting resistor R1.

The inrush current occurring in the electronic ballast when the power supply switch SW1 is closed is limited by this network. During this switch-on operation, the step-up converter of the rectifier arrangement 1 and also the inverter 2 start only with a delay, since the supply voltages for the corresponding switches SW2 and SW3, SW4, respectively, must first be built up. In this switch-on phase, the storage capacitor C2 is charged to the predetermined value of the stabilized DC voltage U+. The inrush current flowing in the process is limited by the limiting resistor R1 connected in series with the storage capacitor C2. As soon as the inverter 2 has started, however, in each case one of its two switches SW3 and SW4 is alternately switched on. The storage capacitor C2 is consequently connected to reference potential Uref via the respectively turned-on switch SW3 or SW4 and the respective coupling diode D6 or D7 connected to the switching path of said switch. Consequently, in steady-state operation, the charging current for the storage capacitor C2 no longer flows via the limiting resistor RI but rather, preferably, via a path connected in parallel with the latter. The further diode D8 connected in parallel with the limiting resistor R1 serves for the controlled discharge of the storage capacitor C2 into the inverter 2. This is the case when the energy instantaneously fed in from the power supply side no longer suffices by itself to operate the inverter 2, this being the case in the region of the zero crossings of the AC power supply voltage u.

FIG. 2 illustrates a further exemplary embodiment of the electronic ballast. In terms of its essential construction, this corresponds to the example already explained above with reference to FIG. 1. Identical circuit elements are identified by identical reference symbols. Only the differences from the exemplary embodiment in accordance with FIG. 1 will be discussed, therefore, in the course of the further description.

First of all, the way in which it is possible to configure the drive unit 5 for the two switches SW3 and SW4 of the inverter 2 is shown in more detail in FIG. 2. In order to generate the supply voltages for these two switches SW3 and SW4 of the inverter 2, the oscillatory transformer T1 has a further secondary winding T1/3, one terminal of which is connected directly to reference potential Uref. Its second terminal is connected via a further charging diode D9 to a second storage capacitor C3, which is connected to reference potential Uref on the other hand. The charge of this second storage capacitor C3 yields the supply voltages for the two switches SW3 and SW4 of the inverter 2, which are designed as transistor switches in this exemplary embodiment. The base terminals of said switches form the control inputs and are in each case connected to one of the winding terminals of a further secondary winding T1/5 of the oscillatory transformer T1, on the one hand, and, via a respective further non-reactive resistor R2 and R3, to the junction point between the second storage capacitor C3 and the charging diode D9 assigned thereto. This junction point is connected via one of these two resistors, R2 in the example, and a further resistor R5 to that output of the rectifier arrangement 1 which supplies the stabilized DC voltage U+. In steady-state operation, the secondary winding T1/5 connected to the base terminals of the switches SW3 and SW4 of the inverter 2 supplies the commutator voltage for alternative activation of said two switches.

Furthermore, in the exemplary embodiment of FIG. 2, the two coupling diodes D6 and D7 of the exemplary embodiment of FIG. 1 are replaced by a further transistor switch Q1, whose switching path is connected in parallel with the limiting resistor R1. This further transistor switch Q1 is also connected via a base resistor R4 to the second storage capacitor C3. Therefore, as soon as the second storage capacitor C3 is sufficiently charged, that is to say the operating state of the inverter 2 has been reached, this further transistor switch Q1 is turned on and short circuits the limiting resistor R1.

FIG. 3 illustrates a further embodiment of the electronic ballast, which differs from the exemplary embodiment in FIG. 2 merely with regard to the driving of the further transistor switch Q1 whose switching path is connected in parallel with the limiting resistor R1. In the case of this alternative, the two emitters of the transistor switches SW3, SW4 of the inverter 2 are connected to the reference potential Uref via a clamping diode D10. Furthermore, this diode is connected in parallel with the emitter-base junction of the further switching transistor Q1. In this exemplary embodiment, too, the limiting resistor R1 ensures that the inrush current is limited during the switch-on operation. However, as soon as the inverter 2 has started, current flows via the reciprocally switched-on transistor switches SW3 and SW4, said current flowing via the clamping diode D10. The voltage drop caused across the clamping diode D10 as a result of this switches on the further transistor switch Q1, which, for its part, short circuits the limiting resistor R1.

The exemplary embodiments described above teach that a simple and cost-effective solution for limiting the inrush current can be realized in an electronic ballast with a rectifier arrangement which supplies a stabilized DC voltage by means of an active step-up converter. In this case, it must merely be ensured that there is a constant ground connection, i.e. conductive connection to the reference potential, during operation. As explained, this can be achieved by means of an inverter in a "push-pull" circuit.

What is claimed is:

1. An electronic ballast having a rectifier arrangement (1) with active step-up converter, said arrangement being fed by AC power supply voltage (u) and, in the output stage of said arrangement, a storage capacitor (C2) being arranged between two outputs connected to high DC voltage potential (U+) and to reference potential (Uref), having an inverter (2) connected to the outputs of the rectifier arrangement and serving to convert the DC voltage fed in via the latter into a high-frequency pulse train, having a load circuit (3) arranged on the output side of the inverter and having at least one fluorescent lamp (La1 and/or La2), and having a network for limiting an inrush current, wherein the inverter has a converter network (T1/1, T1/2, C1, SW3, SW4)—arranged between the DC voltage potential (U+) and reference potential (Uref)—with two bridge paths which, in the steady-state operating condition, are alternatively switched through to the reference potential, and wherein the switching network for limiting the inrush current is formed by a limiting resistor (R1), which, connected in series with the storage capacitor (C2), is connected to the reference potential by its further terminal, the junction point between the storage capacitor and the limiting resistor being coupled to the two bridge paths of the converter network.

2. The electronic ballast as claimed in claim 1, wherein the inverter (2), designed as a push-pull inverter, has a symmetrical oscillatory transformer (T1) with two identical primary windings (T1/1, T1/2), whose first winding terminals are jointly coupled to that output of the step-up converter (1) which is at the high potential (U+), and whose second winding terminals are connected to one another, on the one hand, via a resonance capacitor (C1) and are also connected to the reference potential (Uref), on the other hand, via in each case one of two switches (SW3 and SW4) which are closed alternately.

3. The electronic ballast as claimed in claim 2, wherein the switches (SW3, SW4) of the inverter (2) are designed as bipolar transistors (Q2 and Q3, respectively), via whose switching paths the second winding terminals of the two windings (T1/1, T1/2) of the oscillatory transformer (T1) are respectively connected to the reference potential (Uref), and wherein the inverter furthermore has a drive network (T1/3, T1/4, D7, C3, R2, R3, R5) for the two transistors, said drive network being transformer-coupled to the oscillatory transformer.

4. The electronic ballast as claimed in claim 3, wherein the oscillatory transformer (T1) has a further winding (T1/4) for the purpose of coupling the load circuit (3) to the inverter (2), and the filaments of the at least one fluorescent lamp (La1, La2) are connected to both winding terminals of this further winding directly and via a capacitor (C4 and C5 respectively).

5. The electronic ballast as claimed in claim 3, wherein a reverse-biased diode (D8) is connected in parallel with the limiting resistor (R1).

6. The electronic ballast as claimed in claim 3, wherein a junction point between the storage capacitor (C2) of the rectifier arrangement (1) and the limiting resistor (R1) is connected via a respective coupling diode (D6 and D7) in each case to the terminal of the further switches (SW3 and SW4, respectively) which is connected to one of the second winding terminals of the two primary windings (T1/1 and T1/2, respectively) of the oscillatory transformer (T1).

7. The electronic ballast as claimed in claim 3, wherein those terminals of the two bipolar transistors (SW3 and SW4) of the inverter (2) which are at low potential are, in a manner connected in parallel, connected to the reference potential (Uref) and a further reverse-biased diode (D10), and wherein a bipolar switching transistor (Q1) is provided in the network for limiting the inrush current, said transistor being arranged such that its switching path is connected in parallel with the limiting resistor (R1) and being arranged such that its emitter-base junction is connected in parallel with the further diode (D10).

8. The electronic ballast as claimed in claim 3, wherein the oscillatory transformer (T1) has a third winding (T1/3), whose first winding terminal is connected to the reference potential (Uref) and whose second winding terminal is connected to the reference potential via a forward-biased diode (D9) and also a second storage capacitor (C3), which is connected in series with the latter via a junction point, wherein this junction point is connected via a respective further resistor (R2 or R3) in each case to the base of one of the two transistors (SW3 and SW4) and is also connected via one of these further resistors (e.g. R2) to the high DC voltage potential (U+), and wherein a further winding (T1/5) of the oscillatory transformer is connected, by each of its winding terminals, to the base of one of the two transistors.

9. The electronic ballast as claimed in claim 8, wherein a bipolar switching transistor (Q1) is provided in the network for limiting the inrush current, said transistor being arranged such that its switching path is connected in parallel with the limiting resistor (R1) and the base of said transistor being connected via a further resistor (R4) to the junction point between the second storage capacitor (C3) and the diode (D9) assigned thereto.

10. The electronic ballast as claimed in claim 8, wherein those terminals of the two bipolar transistors (SW3 and SW4) of the inverter (2) which are at low potential are, in a manner connected in parallel, connected to the reference potential (Uref) via a further reverse-biased diode (D10), and wherein a bipolar switching transistor (Q1) is provided in the network for limiting the inrush current, said transistor being arranged such that its switching path is connected in parallel with the limiting resistor (R1) and being arranged such that its emitter-base junction is connected in parallel with the further diode (D10).

11. The electronic ballast as claimed in claim 8, wherein the oscillatory transformer (T1) has a further winding (T1/4) for the purpose of coupling the load circuit (3) to the inverter (2), and the filaments of the at least one fluorescent lamp (La1, La2) are connected to both winding terminals of this further winding directly and via a capacitor (C4 and C5 respectively).

12. The electronic ballast as claimed in claim 8, wherein a reverse-biased diode (D8) is connected in parallel with the limiting resistor (R1).

13. The electronic ballast as claimed in claim 8, wherein a junction point between the storage capacitor (C2) of the rectifier arrangement (1) and the limiting resistor (R1) is connected via a respective coupling diode (D6 and D7) in each case to the terminal of the switches (SW3 and SW4, respectively) which is connected to one of the second winding terminals of the two primary windings (T1/1 and T1/2, respectively) of the oscillatory transformer (T1).

14. The electronic ballast as claimed in claim 2, wherein the oscillatory transformer (T1) has a further winding (T1/4) for the purpose of coupling the load circuit (3) to the inverter (2), and the filaments of the at least one fluorescent lamp (La1, La2) are connected to both winding terminals of this further winding directly and via a capacitor (C4 and C5 respectively).

15. The electronic ballast as claimed in claim 14, wherein a reverse-biased diode (D8) is connected in parallel with the limiting resistor (R1).

16. The electronic ballast as claimed in claim 14, wherein a bipolar switching transistor (Q1) is provided in the network for limiting the inrush current, said transistor being arranged such that its switching path is connected in parallel with the limiting resistor (R1) and the base of said transistor being connected via a further resistor (R4) to the junction point between the second storage capacitor (C3) and the diode (D9) assigned thereto.

17. The electronic ballast as claimed in claim 2, wherein a reverse-biased diode (D8) is connected in parallel with the limiting resistor (R1).

18. The electronic ballast as claimed in claim 17, wherein a bipolar switching transistor (Q1) is provided in the network for limiting the inrush current, said transistor being arranged such that its switching path is connected in parallel with the limiting resistor (R1) and the base of said transistor being connected via a further resistor (R4) to the junction point between the second storage capacitor (C3) and the diode (D9) assigned thereto.

19. The electronic ballast as claimed in claim 2, wherein a junction point between the storage capacitor (C2) of the rectifier arrangement (1) and the limiting resistor (R1) is connected via a respective coupling diode (D6 and D7) in each case to the terminal of the switches (SW3 and SW4, respectively) which is connected to one of the second winding terminals of the two primary windings (T1/1 and T1/2, respectively) of the oscillatory transformer (T1).

* * * * *